United States Patent [19]

Meisen et al.

[11] Patent Number: 4,712,472

[45] Date of Patent: Dec. 15, 1987

[54] METHOD OF AND APPARATUS FOR ALTERING THE MOISTURE CONTENT OF RUNNING WEBS

[75] Inventors: Klaus Meisen, Tönisvorst; Peter Towes, Anrath, both of Fed. Rep. of Germany

[73] Assignee: Kleinewefers Textilmaschinen GmbH, Krefeld, Fed. Rep. of Germany

[21] Appl. No.: 913,533

[22] Filed: Sep. 30, 1986

[30] Foreign Application Priority Data

Oct. 4, 1985 [DE] Fed. Rep. of Germany ..... 3535458

[51] Int. Cl.[4] ..... B30B 3/04; B30B 15/16

[52] U.S. Cl. ..... 100/37; 100/47; 100/211; 100/170; 102/252; 102/262; 102/361; 102/DIG. 10; 29/113 R

[58] Field of Search ..... 100/37, 43, 47, 211, 100/162 B, 176, 170; 162/205, 361, 252, 262, DIG. 10; 29/113 R, 113 AD

[56] References Cited

U.S. PATENT DOCUMENTS

| | | | |
|---|---|---|---|
| 4,384,514 | 5/1983 | Larive et al. | 100/47 X |
| 4,480,452 | 11/1984 | Schnyder | 100/47 X |
| 4,586,983 | 5/1986 | Laapotti | 162/205 |
| 4,612,692 | 9/1986 | Molinatto | 100/162 B X |
| 4,625,637 | 12/1986 | Pav et al. | 100/47 |

OTHER PUBLICATIONS

Brochure "Bico-Flex", D 84.624.1 of Kleinewefers Texilmaschinen GmbH, (No Date or English Translation).

*Primary Examiner*—Andrew M. Falik
*Attorney, Agent, or Firm*—Peter K. Kontler

[57] ABSTRACT

A running web which contains moisture is caused to travel through the nip of two squeezing rollers one of which is deformable in that it comprises a stationary carrier and a cylindrical shell which surrounds the carrier and also surrounds a first set of inflatable cushions adjacent the nip and a second set of inflatable cushions opposite the first set. Sensors monitor the moisture content of selected longitudinally extending portions of the web, and the signals which are generated by such sensors are processed by an evaluating circuit and are transmitted to valves which regulate the pressure of pneumatic fluid in the cushions. Each cushion of the second set registers with a cushion of the first set, and the registering cushions can receive fluid from associated sets of valves including a pressure regulating valve which can increase or reduce the pressure of fluid in the respective cushions and a second valve which can shift the admission of fluid from one into the other of the registering valves. If the moisture content of a marginal portion of the web is to be increased, the pressure in the corresponding cushion of the first set is reduced gradually to zero, and if this does not suffice to increase the moisture content to a desired value, the pressure in the corresponding cushion of the second set is increased so that the respective end portion of the shell of the deformable squeezing roller is actually pulled away from the nip.

20 Claims, 4 Drawing Figures

METHOD OF AND APPARATUS FOR ALTERING THE MOISTURE CONTENT OF RUNNING WEBS

BACKGROUND OF THE INVENTION

The present invention relates to a method of and to an apparatus for altering the moisture content of running webs of textile or like material. More particularly, the invention relates to a method and to an apparatus wherein the web which carries a certain amount of moisture is caused to advance through the nip of two cooperating squeezing rollers at least one of which is deformable so as to allow for changes in the width of the nip.

It is known to advance a web of moisture-containing textile or other material through the nip of two squeezing rollers one of which is elastically deformable so that it allows for changes in the width of selected portions of the nip and to thereby change the moisture content of the corresponding portions of the running web. As a rule, the deformable squeezing roller comprises a stationary carrier in the form of a shaft or beam which is surrounded by a deformable rotary shell the external surface of which defines one side of the nip. The space between the shell and the carrier contains at least one row of elastically deformable inflatable cushions which are connectable to a source of compressed fluid, particularly air, so as to deform the corresponding portions of the shell in response to changes of pressure in selected cushions. It is further known to provide the deformable roll with a second set of cushions which are disposed opposite the first set of cushions and can be inflated to move the shell away from the other roller, i.e., to increase the width of the nip. The pressure in the cushions is regulated in dependency upon the moisture content of the corresponding longitudinally extending portions of the running web. As a rule, the moisture content of different portions of the running web is monitored by suitable sensors, and the thus obtained signals are compared with reference signals denoting the desired or optimum moisture content for the respective longitudinally extending portions of the web. The differences between the signals denoting the actual moisture content and the corresponding reference values are utilized to alter the pressure in the corresponding cushions of the first and/or second set so as to increase the moisture content by moving the deformable squeezing roller away from the other squeezing roller or to reduce the moisture content by moving portions of or the entire deformable squeezing roller toward the other squeezing roller.

Squeezing rollers of the above outlined character are used in many types of padders, squeezers and similar machines. Reference may be had to the brochure entitled "BICO-FLEX" D 84.624.1 of Kleinewefers Textilmashinen GmbH. The brochure describes an apparatus wherein the deformable squeezing roller comprises a first set of three inflatable cushions adjacent the nip and distributed in the longitudinal direction of the deformable roller, and two additional inflatable cushions which constitute the second set and each of which is adjacent an end portion of the deformable shell. When the cushions of the second set are inflated, they pull the shell away from the other squeezing roller. On the other hand, when the cushions of the first set arm inflated, or when the pressure in such cushions is increased, the inflated or pressurized cushions of the first set tend to reduce the width of the nip and to thereby reduce the moisture content of the running web. If the web is sufficiently wide to extend all the way between the end portions of the deformable shell, all three inflatable cushions of the first set are filled with a compressed gas so as to exert a pressure along the full width of the running web. However, if the width of the web is less than the axial length of the deformable shell, compressed gas is admitted only into the two outer cushions of the first set so as to prevent excessive squeezing of the marginal portions of the relatively narrow web.

It was already proposed to automate the operation of the just described apparatus by automatically altering the pressure in selected cushions of the first and/or second set. To this end, the running web is monitored downstream of the nip so as to ascertain the moisture content of its marginal portions and of its central portion. The apparatus further comprises a circuit which compares the actual values of the moisture content in the three moinitored portions of the web with preselected optimum or desirable values, and the pressure in the cushions is regulated in dependency upon deviations of the monitored moisture content from the desired or optimum values.

OBJECTS AND SUMMARY OF THE INVENTION

An object of the invention is to provide a novel and improved method of altering the moisture content of a running web of textile or like material in such a way that the moisture content in different portions of the web can be maintained at or very close to predetermined optimum values.

Another object of the invention is to provide a method which can be practiced with the same advantage in connection with wide, narrow, medium wide, rapidly running or slowly advancing webs of textile or other material which is capable of retaining moisture.

A further object of the invention is to provide a method which can be utilized with advantage in connection with webs that are to retain relatively large or relatively small percentages of moisture upon completion of the moisture removing and/or regulating step.

An additional object of the invention is to provide a novel and improved apparatus for the practice of the above outlined method.

Still another object of the invention is to provide the apparatus with novel and improved means for regulating the admission of a pressurized fluid into the cushions between the deformable shell and the stationary carrier of a squeezing roller which cooperates with a second squeezing roller to define an elongated nip for the running web of a textile or other material.

A further object of the invention is to provide the apparatus with novel and improved means for comparing, evaluating, storing and/or otherwise treating signals which are generated as a result of the monitoring of moisture content in several longitudinally extending portions of sections of the running web.

DESCRIPTION OF THE PREFERRED EMBODIMENTS

Figure 1:
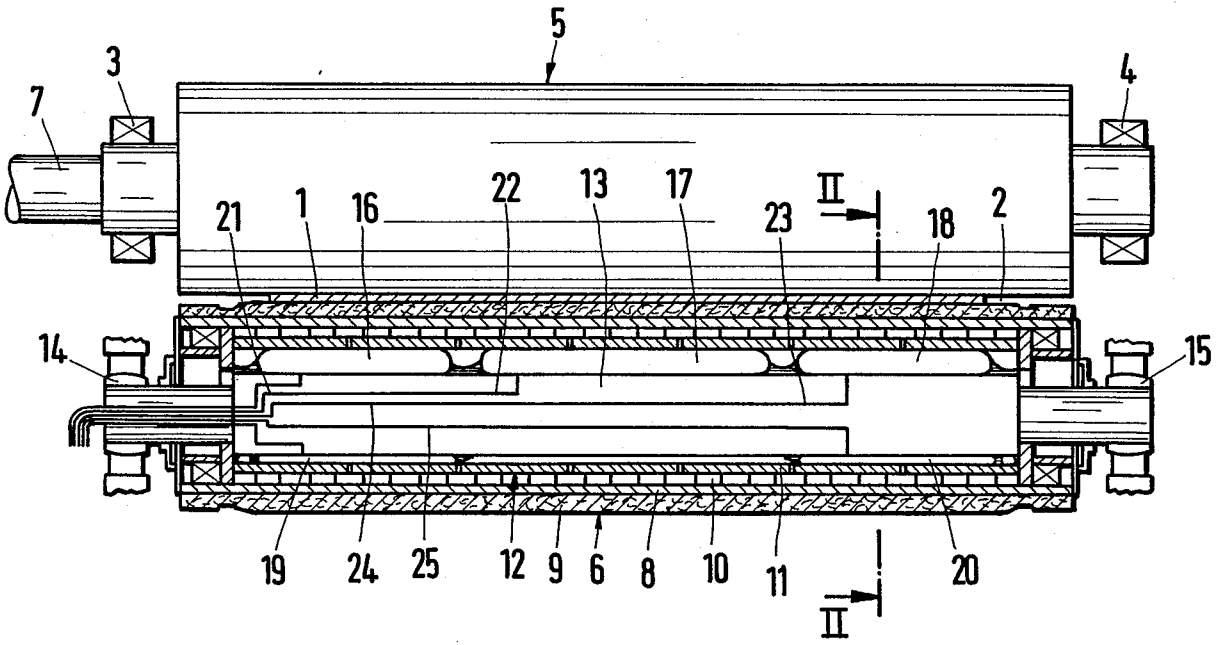
FIG. 1 is a schematic side elevational view of one squeezing roller and an axial sectional view of a deformable second squeezing roller in the apparatus which embodies one form of the present invention.
Figure 2:
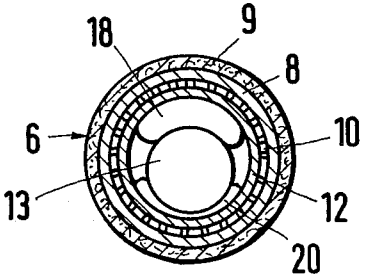
FIG. 2 is a transverse sectional view of the deformable squeeezing roller as seen in the direction of arrows from the line II—II in FIG. 1.

Referring first to FIGS. 1 and 2, there is shown an apparatus which comprises two squeezing rollers 5 and 6 defining an elongated nip 2 for a running web 1 of textile material. The web 1 is caused to advance at right angles to the plane of FIG. 1. The shaft 7 of the squeezing roller 5 is mounted in stationary bearings 3, 4 and is driven by a suitable prime mover (such as a variable-speed electric motor, not shown) so as to advance the web 1 at right angles to the plane of FIG. 1. The squeezing roller 6 is deformable and comprises a stationary (non-rotatable) carrier or holder 13 which is mounted in swivel bearings 14, 15 and is surrounded by a rotary deformable shell 8. The shell 8 rotates because it is in contact with the running web 1 in the nip 2 between the rollers 5 and 6. The material of the web 1 can constitute a strip of fabric, knitwear, non-woven fabric or another textile or other fibrous material which has advanced through a liquid bath prior to entering the nip 2. The purpose of the squeezing rollers 5 and 6 is to reduce the moisture content of the web 1 to a predetermined value. The squeezing rollers 5 and 6 can constitute component parts of a dyeing or finishing padder.

The deformable shell 8 of the squeezing roller 6 comprises an elastically deformable outer layer 9 which can be made of hard rubber. Such outer layer 9 surrounds an annulus of roller bearings 10 which, in turn, surround an inner tube 12 consisting of a group of coaxial sleeves 11. The shell 8 spacedly surrounds the stationary carrier 13 and confines a first set of three aligned inflatable cushions 16, 17 and 18 which are disposed between the carrier 13 and the nip 2. The shell 8 further surrounds a second set of inflatable cushions 19 and 20 which are adjacent the end portions of the shell 8 and are in register with the cushions 16, 18 of the first set, respectively. The dimensions (as considered in the longitudinal direction of the nip 2) of the cushions 19, 20 preferably match or approximate the dimensions of the respective aligned or registering cushions 16, 18 of the first set.

The cushions 16–20 can be made of a reinforced elastomeric material and are preferably designed to resist internal pressures in the range of up to 12 bar. However, the improved apparatus can also employ inflatable cushions which constitute or include metallic membranes, bellows or the like. The cushions 16–20 are connectable with a source Q (FIG. 3) of compressed pneumatic fluid (such as air) by discrete conduits 21, 22, 23, 24 and 25, respectively. In the illustrated embodiment, the apparatus comprises three cushions 16–18 which constitute the first set and two cushions 19–20 which constitute the second set. However, it is equally within the purview of the invention to provide the apparatus with a larger number of cushions which form the first set and a correspondingly increased number of cushions which form the second set. For example, the apparatus can comprise five cushions which constitute the first set and four cushions which constitute the second set. The arrangement is preferably such that the first set comprises a centrally located cushion (such as 17) and at least one cushion at each side of the centrally located cushion. The cushion 16 of the first set registers with the cushion 19 of the second set, and the cushion 18 of the first set registers with the cushion 20 of the second set.

The means for monitoring the moisture content of several portions of sets a, b, c of the running web 1 comprises three sensors 26, 27, 28 (see the upper right-hand portion of FIG. 3) and a signal comparing and evaluating circuit 29 which receives signals $i_a$, $i_b$, $i_c$ from the sensors 26, 27, 28, respectively. The sensors 26–28 are located downstream of the nip 2 of the squeezing rollers 5, 6, as considered in the direction of travel of the running web 1. The exact construction of the sensors 26–28 forms no part of the present invention. Each such sensor can constitute a capacitive monitoring element which can ascertain the moisture content of the respective longitudinally extending portion or section of the running web 1, for example, in a manner known from determining the moisture content of a stream or layer of fibrous material, such as tobacco. It is also possible to employ sensors which operate with microwaves or with isotope radiation. The sensors 26–28 need not directly monitor the moisture content of the respective longitudinally extending portions or sections of the running web 1. It suffices to ascertain certain parameters which are directly or indirectly related to the moisture content of the respective portions of the running web. 1. For example, the sensors 26–28 can be designed to ascertain the overall mass of the moisture-containing web or the color intensity of the web. The sensor 26 monitors the moisture content of that portion (a) of the running web 1 which is in register with the inflatable cushions 16 and 19, the sensor 27 monitors the moisture content of the web portion or section b which is disposed intermediate the marginal portions or sections of the web 1, and the sensor 28 monitors the moisture content of the web portion or section c which is in register with the inflatable cushions 18 and 20.

The outputs of the sensors 26, 27, 28 respectively transmit signals $i_a$, $i_b$, $i_c$ to the corresponding inputs of the signal comparing and evaluating circuit 29 which forms part of the monitoring means. The apparatus further comprises a source 30 of reference signals Sa, Sb, Sc which respectively denote the desired or optimum values of the moisture content of web portions or sections a, b, c. The reference signals Sa, Sb, Sc are transmitted to the corresponding inputs of the evaluating circuit 29 which has outputs for transmission of signals Ya, Yb, Yc denoting the differences between the intensities and/or other characteristics of signals $i_a$, $i_b$, $i_c$ on the one hand and reference signals Sa, Sb, Sc on the other hand.

The evaluating circuit 29 of the monitoring means further comprises additional inputs 31 which can receive additional data, such as signals denoting the weight of the web 1, the moisture content of the corresponding portions of the web 1 after the web has left the nip of the preceding set of rollers and/or others.

The illustrated evaluating circuit 29 is assumed to be a PID circuit which can transmit output signals Ya, Yb, Yc denoting the differences between the signals $i_a$, $i_b$, $i_c$ on the one hand and the signals Sa, Sb, Sc on the other hand, the signals Ya–Yc being influenced or being adapted to be influenced by signals which are transmitted to the respective inputs 31 of the evaluating circuit 29.

The signals $Y_a$, $Y_b$, $Y_c$ are transmitted to a regulating circuit including three input circuits 32a, 32b, 32c and three controlling means 33, 34, 35 which are connected with the outputs of the input circuits 32a, 32b, 32c, respectively. The controlling means 33, 34, 35 respectively comprise valves 36, 37, 38 which can regulate the pressure of pneumatic fluid flowing from the source Q to the cushions 16, 19 - 17 - 18, 20, respectively. Furthermore, the controlling means 33 and 35 comprise selector or switchover valves 42 and 43 which can respectively shift the admission of pressurized fluid from the cushion 16 to the cushion 19 or vice versa and from the cushion 18 to the cushion 20 or vice versa. The source Q contains a pressurized pneumatic fluid which is maintained at a constant pressure Po. Such source is connected with the valves 36, 37, 38 by conduits 39, 40, 41 respectively. The valves 36, 37, 38 are designed to reduce the pressure of pneumatic fluid which flows from the source Q to the respective cushions 16 (or 19), 17, 18 (or 20). The source Q can comprise an air compressor and a device which maintains the pressure at the outlet of the compressor at a constant value (Po). The pressure of pneumatic fluid in the conduit 39 downstream of the valve 36 is denoted by the character $P_a$. The pressure of pneumatic fluid in the conduit 40 downstream of the valve 37 equals $P_b$, and the pressure in the conduit 41 downstream of the valve 39 equals $P_c$.

Figure 3:
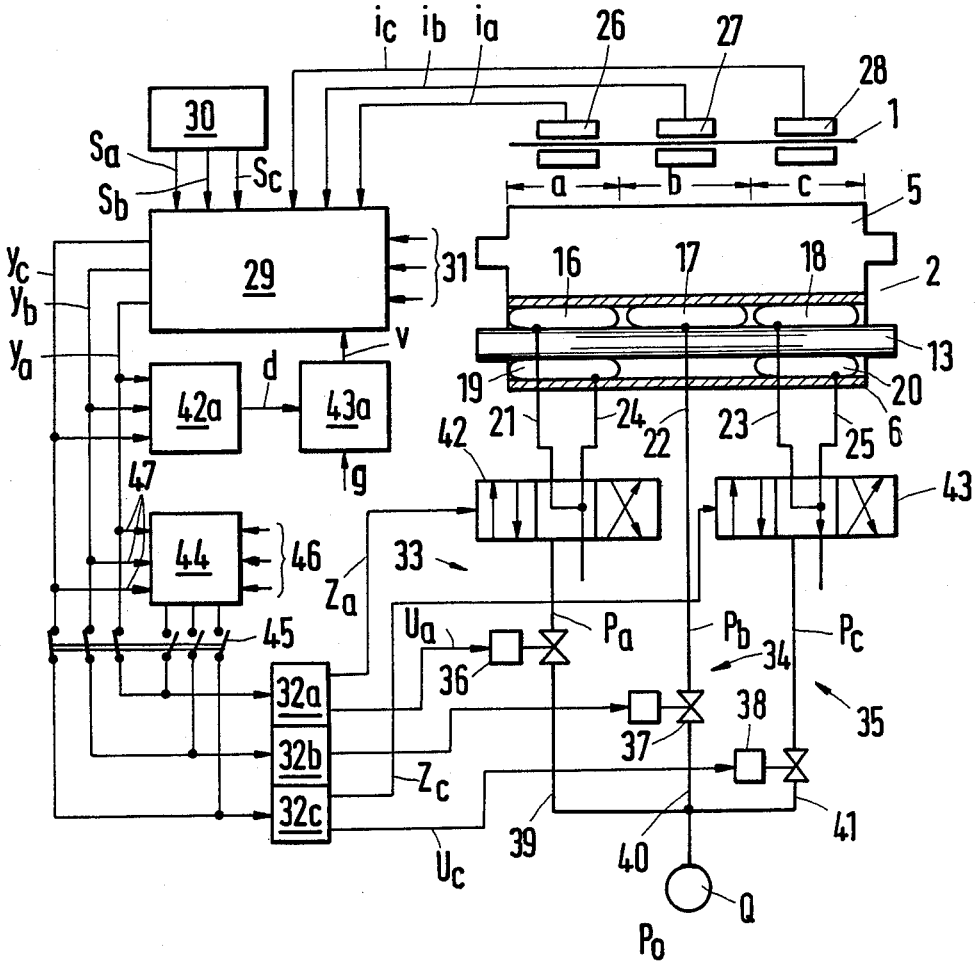
FIG. 3 is a block diagram of the monitoring and regulating means for altering the width of the nip between the two squeezing rollers in response to controlled deformation of the shell of the second squeezing roller.

FIG. 3 shows that the controlling means 35 comprises only the valve 37 which is installed in the conduit 41 between the source Q and the cushion 17 of the first set. The downstream portion of the conduit 40 constitutes the aforementioned conduit 22. The controlling means 33 comprises the valve 36 which is installed in the conduit 39 downstream of the source Q and the aforementioned selector or switchover valve 42 which can cause the pressurized fluid flowing in the conduit 39 to enter the cushion 16 of the first set (via conduit 21) or the registering or aligned cushion 19 of the second set (via conduit 24). Analogously, the controlling means 35 comprises the valve 38, which is installed in the conduit 41 downstream of the source Q, and the switchover or selector valve 43 which is installed in the conduit 41 downstream of the valve 38 and can admit pneumatic fluid into the cushion 18 of the first set (via conduit 23) or into the registering or aligned cushion 20 of the second set (via conduit 25). The arrangement is such that the cushion 16 is connected with the outlet of the valve 36 when the cushion 19 is permitted to communicate with the atmosphere, and vice versa. The same applies for the cushions 18 and 20.

Figure 4:
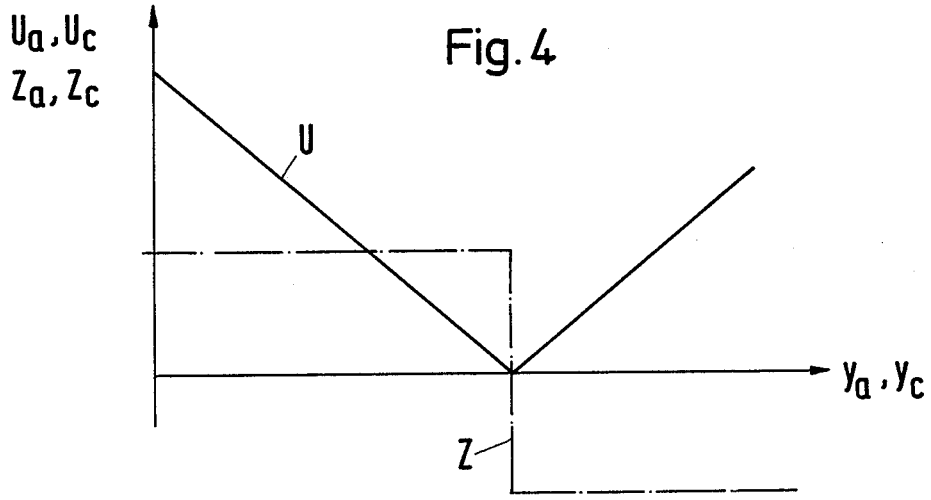
FIG. 4 is a diagram showing changes of fluid pressure in a selected cushion of a first set of cushion and in the corresponding cushion of a second set of cushions.

The input circuit 32a transmits a signal Za to the selector or switchover valve 42 and a control signal $U_a$ to the valve 36 of the controlling means 33 in dependency upon the characteristics of the signal $Y_a$ according to the curve U which is shown in FIG. 4. The operation of the input circuit 32c is analogous, i.e., this circuit can transmit a signal $Z_c$ to the switchover or selector valve 43 and a signal $U_c$ to the valve 38. If the signal Z is a positive signal, the source Q is caused to admit pressurized pneumatic fluid to the cushion 16 or 18. If the signal Z is a negative signal, the source Q admits pressurized fluid to the cushion 19 and/or 20. If the signal Y is a continuous signal which is indicative of increasing moisture content, the intensity of the signal U (which in the simplest case is proportional to the desired pressure P) decreases continuously until it reaches the zero value. At such time, the selector or switchover valve 42 or 43 switches over from admission of pressurized fluid from the cushion 16 or 18 to the cushion 19 or 20. The pressure P then increases continuously. If the apparatus is to reduce the moisture content of the respective portions or sections a, b or c of the running web 1, the mode of operation is reversed. All in all, the apparatus is capable of regulating the moisture content of the web portions or sections a, b, c within a rather wide range, namely in a positive direction from zero to the maximum or full pressure $P_o$ and in the negative direction from zero to the same or nearly same pressure $P_o$.

The apparatus which embodies the circuit of FIG. 3 further comprises a computer 42a which, together with a signal comparing stage 43a, constitutes a device for monitoring the pressure in the inflatable cushions 16–20. More specifically, the computer 42a receives signals (from the conductors which transmit the signals $Y_a$, $Y_b$, $Y_c$) denoting the pressures $P_a$, $P_b$ and $P_c$ in the respective cushions. The computer evaluates such signals on the basis of the dimensions of the respective cushions and generates signals which are indicative of forces acting in a direction toward the nip 2 as well as forces (generated by the cushions 19, 20) which act in a direction away from the nip 2. The signals which denote the differences d between such forces are transmitted to the signal comparing stage 43a which also receives signals denoting a threshold value g. The output of the signal comparing stage 43a transmits (second) signals v to the corresponding input of the signal comparing or evaluating circuit 29 of the monitoring means including the sensors 26–28. When the difference d drops below the threshold value g, the signal comparing stage 43a transmits a signal v which ensures that the difference between the pressures in the cushions 16, 19 or 18, 20 does not decrease any further. This can be achieved by preventing any further increase of pressure in the active second cushion 19 or 20 and/or of increasing the pressure in the active first cushion 16 or 18.

The apparatus further comprises a memory 44 which serves to receive signals $Y_a$, $Y_b$, $Y_c$ or analogous signals and can transmit such signals to the input circuits 32a, 32b, 32c upon restarting of the motor which drives the squeezing roller 5. The arrangement is such that the input circuits 32a–32c receive signals from the memory 44 when the evaluating circuit 29 is not as yet ready to transmit appropriate signals $Y_a$, $Y_b$, $Y_c$, for example, immediately after starting of the motor for the shaft 7 which drives the squeezing roller 5 and hence the web 1 and the shell 8 of the deformable squeezing roller 6. The inputs 46 of the memory 44 can receive manually transmitted signals, and the inputs 47 of the memory 44 are connected with the conductors which respectively transmit the signals $Y_a$, $Y_b$ and $Y_c$. The inputs 46 can receive manually applied signals intermittently, and the inputs 47 can continuously receive signals from the conduits for the signals $Y_a$–$Y_C$ when the motor which drives the shaft 7 is on. Thus, when the motor for the shaft 7 is arrested, the memory 44 stores the last signals $Y_a$–$Y_c$, and such signls are transmitted to the input circuits 32a–32c in response to closing of the switches 45 which constitute a means for connecting the memory 44 to the circuit 32a–32c.

When the improvided apparatus is in use, the sensors 26, 27, 28 ascertain the moisture content of the respective portions or sections of the running web 1. If the sensors 26–28 detent that the web 1 contains an insufficient quantity of moisture, the pressure ($P_a$, $P_b$, $P_c$) in the corresponding cushions 16, 17, 18 of the first set of cushions is reduced. In other words, the width of the nip 2 is increased so that the rollers 5 and 6 expel less moisture from the running web 1. As a rule, the moisture content is too low in the marginal portion a and/or c of the running web 1. The valve 36 and/or 38 then continuously and gradually reduces the pressure in the respective cushion 16 and/or 18, and such pressure can be reduced to zero if the moisture content in the respective portion or section a and/or c of the running web 1 is still too low. If such undertaking does not suffice, i.e., if the moisture content in the section or portion a and/or c is still too low, the valve 42 and/or 43 switches over from the cushion 16 and/or 18 to the cushion 19 and/or 20 when the pressure in the cushion 16 and/or 18 is reduced to zero, and the pressure in the cushion 19 and/or 20 then increases gradually so that the cushion 19 and/or 20 pulls the corresponding portion of the shell 8 away from the nip 2 and thereby contributes to an increase of the moisture content in the respective portion or section a and/or c of the web 1. The adjustment of pressure in the median or central cushion 17 of the first set can be regulated in dependency upon the regulation of pressure in the cushion 19 and/or 20 of the second set.

By way of example, the web 1 can constitute a strip of knitwear which has passed through a moisturizing device and is thereupon caused to advance through the nip 2 so as to reduce its moisture content from a relatively high value to approximately 60 percent. Alternatively, the web can pass through a padder wherein the moisture content is to be reduced from a very high value to 80 percent with reference to the specific weight of the running web. The pressure in the median cushion 17 is regulated so that it is approximately 2 bar, and the pressure in the cushions 19, 20 of the second set is approximately 0.5 bar.

The improved apparatus can be modified in a number of ways without departing from the spirit of the invention. For example, and as mentioned above, the first and second sets can comprise a relatively large number of cushions; the number of cushions in the first set can equal four, five or more, and the number of cushions in the second set can equal three, four or more. Furthermore, the number of sensors (26–28) can be increased to four or more. Still further, the three-position selector or switchover valves 42 and 43 can be replaced with sets of two or more discrete valves each of which has a valving element movable between two different positions. The valves 42, 43 and/or analogous valves can be actuated electrically, magnetically, pneumatically, hydraulically or in any other suitable way. Still further, the computer 42 need not receive the signals Y; instead, it can also receive signals which are indicative of the pressure P or of the corresponding signals U. In addition, the switchover or selector valves 42, 43 can be actuated in dependency upon the actually prevailing pressure in the corresponding conduits 39,41, i.e., in dependency upon the pressure $P_a$ or $P_c$.

Each of the valves 36, 37, 38 can comprise a motor which serves to rotate a feed screw and is reversible so that the feed screw can move a valving element toward or away from the associated seat or seats.

An important advantage of the improved method and apparatus is that the range of adjustments of moisture content of selected portions or sections of the web 1 is much wider than in accordance with heretofore known proposals. When a cushion (19 or 20) of the second set is used to regulate the moisture content, such cushion invariably regulates the moisture content only in the corresponding portion or section of the web. The improved method and apparatus can be utilized with particular advantage to ensure that the web will contain a predetermined quantity of moisture close to the maximum content or close to a very high moisture content. The method and apparatus can be utilized to ensure that the moisture content of several longitudinally extending portions or sections of the running web 1 will be the same or that each such portion or section of the running web will contain a different percentage or quantity of moisture. This is or can be desirable when the weight of the web is not constant all the way from the one to the other marginal portion. It has been found that, quite surprisingly, even very small changes of pressure in the cushion 19 and/or 20 of the second set suffice to ensure that the corresponding portion or section of the running web contains a preselected quantity of moisture. Furthermore, the possibility of regulating the width of selected portions or sections of the nip 2 independently of each other renders it possible to invariably ensure that the squeezing rollers 5 and 6 define a nip of preselected width.

At least in many instances, it suffices to provide a second set of cushions which includes only two cushions (19 and 20) each of which is adjacent one marginal portion of the web. This is due to the fact that, as a rule, the regulation of moisture content of the median or central portion or section (b) of the web is much simpler than the regulation of moisture content in the marginal portion a and/or c which is probably attributable to the design of the apparatus and/or to the fact that the weight of the web is normally greater in the regions of its marginal portions.

Of course, it is not always necessary to reduce the pressure in the cushions of the first set to zero prior to increasing the pressure in the cushions of the second set. For example, it is possible to reduce the pressure in the cushion 16 and/or 18 to a certain value above zero before the pressure in the corresponding or registering cushion 19 and/or 20 is increased. Such mode of operation even further enhances the regulation of moisture content of the respective portions or sections of the web. As a rule, or at least in many instances, the regulation will be carried out in such a way that the pressure in the cushion 16 and/or 18 is reduced to zero before the pressure in the cushion 19 and/or 20 is increased above zero. This mode of operation invariably ensures a predictable selection of the moisture content in the respective portions or sections a and c of the running web 1.

The computers 42*a* and the signal comparing stage 43*a* can accumulate signals which are indicative of an image of pressures prevailing in the cushions 16–20. More specifically, the circuits 42*a* and 43*a* can ensure the establishment of a replica of differences d between the pressures in the cushions 16, 19 and 18, 20, and such differences (d) are transmitted to the signal comparing stage 43*a* which, in turn, transmits (second) signals v to the corresponding input of the evaluating circuit 29 forming part of the monitoring means. As mentioned above, the signals d are compared with signals g which denote the preselected threshold value, and the arrangement is such that the stage 43*a* transmits signals v to the evaluating circuit 29 when the intensity of signals d is less than the intensity of signals g. This entails the generation of a signal which prevents a further increase or rise of pressure in the active cushion 19 and/or 20 and/or an increase of pressure in the active cushion 16 and/or 18. Such mode of regulating the pressure in the cushions 16, 18, 19 and 20 ensures that the roller 6 is not lifted off the roller 5 under any foreseable operating conditions.

An advantage of the memory 44 is that it ensures proper, or at least nearly proper, operation of the deformable roller 6 immediately after starting of the web 1. This, in turn, ensures that the pressures in the cushions need not flucutate abruptly when the evaluating circuit 29 begins to transmit signals Ya–Yc to the input circuits 32*a*–32*c*. As mentioned above, those signals which are memorized at 44 can be transmitted by hand (at 46), or the memorized signals can be those which are transmitted by the conductors for the signals $Y_a$–$Y_c$. The signals which are transmitted to the inputs 46 can be determined empirically on the basis of tests. The step of storing signals which are transmitted to the inputs 47 is preferred at this time because such signals can constitute or correspond to those which are generated by the evaluating circuit 29 immediately or shortly prior to stoppage of the web 1.

The provision of combinations of valves 36, 42 and 38, 43 renders it possible to continuously alter the pressure in the cushion 16 and/or 18 from a maximum value to zero and to thereupon alter the pressure in the cushion 19 and/or 20 from zero to a selected value in order to ensure that the ultimate moisture content of the respective portion or section of the web will closely approximate or match the value which is denoted by the corresponding reference signal $S_a$ or $S_c$. The same applies when the pressure in the cushion 19 and/or 20 is reduced from a maximum value to zero and the pressure in the associated or registering cushion 16 and/or 18 is thereupon increased from zero to that value which is required in order to ensure that the corresponding portion or section a and/or c of the running web 1 will equal or approximate the required optimum value. The operation of the input circuits 32*a* and 32*c* is such that the valves 36 and 38 are opened or closed gradually and that the valves 42 and 43 are actuated when the pressure in the cushion 16 or 19 (valve 42) or 18 or 20 (valve 43) is reduced to zero. The utilization of a valve 36 or 38 which is common to the cushions 16, 19 or 18, 20 contributes to compactness and simplicity of the deformable squeezing roller.

Without further analysis, the foregoing will so fully reveal the gist the present invention that others can, by applying current knowledge, readily adapt it for various applications without omitting features that, from the standpoint of prior art, fairly constitute essential characteristics of the generic and specific aspects of our contribution to the art and therefore, such adaptations should and are intended to be comprehended within the meaning and range of equivalence of the appended claims.

We claim:

1. A method of altering the moisture content of a running web of textile or like material in the elongated nip of two squeezing rollers at least one of which is deformable so as to allow for changes in the width of the nip, comprising the steps of monitoring the moisture content of a plurality of web portions which are spaced apart from each other in the longitudinal direction of the nip and each of which is in line with a different portion of the one roller; individually biasing said portions of the one roller toward the other of the rollers so as to exert pressure upon the corresponding portions of the web; comparing the monitored moisture content with predetermined reference values and generating signals denoting deviations of monitored moisture content from the respective reference values; reducing the bias upon a selected portion of the one roller, with attendant increase in the moisture content of the corresponding portion of the web, when the respective signal denotes insufficient moisture content; and biasing the selected portion of the one roller away from the other roller by increasing the pressure upon a further selected portion of said roller substantially on the opposite side of said selected portion when the bias upon the selected portion is reduced to zero but the moisture content of the corresponding portion of the web is still below that which is denoted by the respective reference signal.

2. The method of claim 1, further comprising the steps of reducing the bias upon the selected portion of the one roller in a direction to move the selected portion away from the other roller when the moisture content of the corresponding portion of the web exceeds the respective predetermined value whereby the moisture content of the corresponding portion of the web is reduced, and increasing the bias upon the one roller in a direction toward the other roller when the bias upon the selected portion in a direction away from the other roller is reduced to zero but the moisture content of the corresponding portion of the web still exceeds the respective reference value.

3. The method of claim 2, wherein each of said bias reducing and bias increasing steps upon the selected portion of the one roller is carried out gradually and continuously.

4. The method of claim 2, wherein the step of reducing the bias upon a selected portion of the one roller in a direction to move the selected portion away from the other roller includes reducing the bias upon a portion of the one roller which extends along a part only of the width of the web.

5. The method of claim 1, wherein the nip has two end portions and those portions of the one roller which can be biased in a direction away from the other roller are adjacent the end portions of the nip.

6. The method of claim 1, wherein the one squeezing roller has a stationary carrier, a deformable rotary shell surrounding the carrier, a first set of pneumatically inflatable cushions between the carrier and the shell in the region of the nip, and a second set of pneumatically inflatable cushions between the shell and the carrier opposite the cushions of the first set, said biasing and bias reducing steps including increasing or reducing the pressure of pneumatic fluid in selected cushions within the shell.

7. The method of claim 6, further comprising the steps of monitoring the pressure of pneumatic fluid in the cushions, ascertaining the difference between the pressures of fluid in at least some cushions of the first set and in the corresponding cushions of the second set, generating second signals denoting the differences between the pressures in the cushions of the first set and the pressures in the corresponding cushions of the second set, and increasing the pressure of fluid in the cushions of the first set and/or preventing any further rise of fluid pressure in the cushions of the second set when the respective differences drop below preselected values.

8. The method of claim 1, further comprising the steps of arresting the web, memorizing the signals which are generated prior to the arresting step, starting the web, and utilizing the memorized signals to regulate the bias upon the portions of the one roller in the course of the starting step.

9. The method of claim 8, wherein said memorizing step includes memorizing signals which are generated shortly or immediately prior to said arresting step.

10. Apparatus for altering the moisture content of a running web of textile or like material, comprising first and second squeezing rollers defining an elongated nip for the web, at least one of said rollers having a stationary carrier, a deformable rotary shell surrounding said carrier, a first set of inflatable cushions between said carrier and said shell adjacent said nip, and a second set of inflatable cushions between said carrier and said shell opposite the cushions of said first set; monitoring means including sensors arranged to determine the moisture content of a plurality of web portions which are spaced apart from each other in the longitudinal direction of the nip and are in line with the cushions of said first set, and to generate signals denoting the monitored moisture content; a source of pressurized pneumatic fluid; means for connecting said source with said cushions; and means for regulating the pressure of fluid in said cushions as a function of said signals, including means for controlling the flow of fluid between said source on the one hand and at least one cushion of said first set and the corresponding cushion of said second set on the other hand in response to signals from the sesnsor in line with said one cushion, said controlling means including means for reducing the pressure in the one cushion of said first set when the respective signal denotes that the moisture content of the corresponding portion of the web is below a predetermined value and for increasing the pressure in the corresponding cushion of the second set when the pressure in the one cushion of the first set is reduced to zero but the moisture content of the corresponding portion of the web is still below the predetermined value.

11. The apparatus of claim 10, further comprising means for rotating the other of said rollers.

12. The apparatus of claim 10, wherein said monitoring means further comprises means for comparing the signals which are generated by said sensors with reference signals denoting the predetermined values of moisture content of the respective portions of the web.

13. The apparatus of claim 10, wherein said controlling means comprises a first valve arranged to regulate the pressure of fluid in said one cushion of the first set and in the corresponding cushion of the second set as a function of characteristics of the signal from the corresponding sensor, and a second valve arranged to selectively connect the source with the one cushion of said first set or with the corresponding cushion of said second set.

14. The apparatus of claim 13, wherein said first valve includes means for gradually changing the pressure of fluid in the respective cushions of said first and second sets in response to a gradually changing signal from the corresponding sensor so that the pressure of fluid in the one cushion of the first set is reduced to zero and the pressure of fluid in the corresponding cushion of the second set is thereupon increased subsequent to actuation of said second valve.

15. The apparatus of claim 10, wherein said one roller has a central portion and said first set comprises first and second cushions at opposite sides of said central portion, said second set comprising first and second cushions in register with the first and second cushions of said first set, said regulating means including means for controlling the flow of fluid between said source and said first cushions and means for controlling the flow of fluid between said source and said second cushions.

16. The apparatus of claim 10, further comprising a memory for said signals and means for connecting said memory with said controlling means.

17. The apparatus of claim 16, wherein said monitoring means includes means for evaluating the signals from said sensors and conductor means connecting said evaluating means with said controlling means as well as with said memory.

18. The apparatus of claim 10, further comprising a device for monitoring the pressures of fluid in said cushions and for generating second signals denoting the differences between the pressures in the cushions of said first set and the corresponding cushions of said second set, said monitoring means including means for influencing the signals from said sensors as a function of said second signals.

19. The apparatus of claim 18, wherein said monitoring device includes a computer which receives signals denoting the moisture content of the portions of the web and said influencing means includes an evaluating circuit which modifies the signals transmitted to said computer as a function of said second signals.

20. The apparatus of claim 10, wherein the number of cushions in said first set exceeds the number of cushions in said second set.

* * * * *